US008740405B2

(12) United States Patent
Yamazaki

(10) Patent No.: US 8,740,405 B2
(45) Date of Patent: Jun. 3, 2014

(54) LIGHTING APPARATUS

(75) Inventor: Makoto Yamazaki, Kanagawa-ken (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 184 days.

(21) Appl. No.: 13/157,123

(22) Filed: Jun. 9, 2011

(65) Prior Publication Data

US 2011/0305013 A1 Dec. 15, 2011

(30) Foreign Application Priority Data

Jun. 10, 2010 (JP) ..... P2010-133369
Jun. 10, 2010 (JP) ..... P2010-133409

(51) Int. Cl.
*F21S 4/00* (2006.01)

(52) U.S. Cl.
USPC ..... 362/223

(58) Field of Classification Search
USPC ..... 362/223
See application file for complete search history.

(56) References Cited

U.S. PATENT DOCUMENTS

| | | | | |
|---|---|---|---|---|
| 6,135,613 | A * | 10/2000 | Bodell et al. | 362/223 |
| 6,158,882 | A | 12/2000 | Bischoff, Jr. | |
| 2008/0030981 | A1* | 2/2008 | Mrakovich et al. | 362/219 |
| 2010/0008085 | A1 | 1/2010 | Ivey et al. | |
| 2010/0290218 | A1* | 11/2010 | Yang et al. | 362/223 |
| 2011/0058377 | A1 | 3/2011 | Chou et al. | |
| 2011/0235320 | A1 | 9/2011 | Cai et al. | |

FOREIGN PATENT DOCUMENTS

| | | |
|---|---|---|
| AU | 20099319564 | 6/2010 |
| CN | 2544180 | 4/2003 |
| CN | 101059229 | 10/2007 |
| CN | 201078609 | 6/2008 |
| CN | 201232887 | 5/2009 |
| CN | 20129109 | 6/2009 |
| CN | 101691923 | 4/2010 |
| DE | 20 2010 001 126 | 5/2010 |
| EP | 2 385 292 | 11/2011 |
| GB | 2 429 112 | 2/2007 |
| JP | 07-002317 | 1/1995 |
| JP | 2007-035507 | 2/2007 |
| JP | 2007-122945 | 5/2007 |
| JP | 2010-123359 | 6/2010 |
| KR | 10-2010-0009201 | 1/2010 |
| WO | WO 2010/047973 | 4/2010 |

OTHER PUBLICATIONS

English Language Abstract of JP 2010-123359 published on Jun. 3, 2010.
English Language Translation of JP 2010-123359 published on Jun. 3, 2010.

(Continued)

*Primary Examiner* — Stephen F Husar
*Assistant Examiner* — James Cranson, Jr.
(74) *Attorney, Agent, or Firm* — DLA Piper LLP (US)

(57) ABSTRACT

In one embodiment, a lighting apparatus includes a light source unit having light emitting units arranged in a longitudinal direction. A transparent cover member is formed in a substantially straight pipe shape and having openings at both ends for housing the light source unit along the longitudinal direction. The cover member has a higher thermal expansion coefficient than that of the light source unit. End plate members are fixed to the both ends of the light source unit and close the openings at the both ends of the cover member.

4 Claims, 9 Drawing Sheets

(56) References Cited

OTHER PUBLICATIONS

Partial English Language Translation of JP 07-002317 published Jan. 25, 1995.
Chinese Office Action issued in CN 201110150411.5 issued Feb. 1, 2013.
English Language Translation of Chinese Office Action issued in CN 201110150411.5 issued Feb. 1, 2013.
English Language Abstract of JP 2007-122945 published May 17, 2007.
English Language Translation of JP 2007-122945 published May 17, 2007.
English Language Abstract of JP 2007-035507 published Feb. 8, 2007.
English Language Translation of JP 2007-035507 published Feb. 8, 2007.
Chinese Office Action issued in CN 201110150411.5 on Jul. 23, 2013.
English Language Translation of Chinese Office Action issued in CN 201110150411.5 on Jul 23, 2013.
English Language Abstract of CN 201078609 published Jun. 25, 2008.
English Language Abstract of CN 201232887 published May 6, 2009.
English Language Abstract of CN 2544180 published Apr. 9, 2003.
English Language Abstract of CN 101059229 published Oct. 24, 2007.
English Language Abstract of KR 10-2010-0009201 published Jan. 27, 2010.
European Search Report issued in EP 11168946.9 dated Dec. 12, 2013.
English Language Abstract for AU 2009319564 published Jun. 3, 2010.

* cited by examiner

LIGHTING APPARATUS

CROSS-REFERENCE TO RELATED APPLICATION

This application is based upon and claims the benefit of priority from Japanese Patent Applications No. 2010-133369 and No. 2010-133409, respectively filed Jun. 10, 2010, the entire contents of which are incorporated herein by reference.

FIELD

Embodiments described herein relate generally to a lighting apparatus.

BACKGROUND

Lighting devices such as an LED lamp and a lighting apparatus using a light emitting diode as a light source. i.e., a solid-state light emitting device, are commercially available. These devices may consume low electric power and have long life, and they may be used in place of a filament bulb or fluorescent lamp. These lighting apparatuses may include long and narrow straight pipe-shaped lighting apparatuses and LED lamps. The pipe-shaped lighting apparatuses and LED lamps can be used in place of the straight pipe fluorescent lamps widely employed in storage containers such as refrigerators and in indoor and outdoor lighting apparatuses, for example.

However, when the lighting apparatuses and LED lamps are used for illumination in a refrigerator in particular, the use environment is about −25.degree. C. When they are installed outdoors, the temperature is 40.degree. C. or more under burning sun in the summer. In these cases, components constituting these lighting apparatuses, i.e., synthetic resin components and metal components, have different thermal expansion coefficients. For example, in the lighting apparatus made by fixing a light source unit mainly having many metal components having small thermal expansion coefficients onto a transparent tubular cover member made with a synthetic resin having a high thermal expansion coefficient, the thermal expansion coefficient of the cover member is different from the thermal expansion coefficient of the light source unit. For example, when the lighting apparatus is used in an environmental temperature of −25.degree. C., the cover member made of the synthetic resin shrinks more than the light source unit. On the contrary, when the light source unit is placed under burning sun outdoors, the cover member expands more than the light source unit.

The light source unit is affected by stress caused by expansion and shrink of the cover member, and this is one of the causes of malfunction of electronic components including a semiconductor device such as a light emitting diode. Further, when the cover member shrinks, a space is made between components, and this causes the unit to lose air tightness and waterproofing To reduce or avoid these problems components having different thermal expansion coefficients may be carefully configured.

BRIEF DESCRIPTION OF THE DRAWINGS

The accompanying drawings, which are incorporated in and configure a portion of the specification, illustrate embodiments of the invention, and together with the general description given above and the detailed description of the embodiments given below, serve to explain the principles of the invention.

FIGS. 1A and 1B illustrate a lighting apparatus according to an embodiment, wherein FIG. 1A is a perspective view, and FIG. 1B is a cross-sectional view taken along line B-B of FIG. 1A;

FIGS. 5A and 5B illustrate a packing portion of the lighting apparatus according to the embodiment, wherein FIG. 5A is an enlarged cross-sectional view illustrating the packing portion arranged between the end plate member and the cover member, and FIG. 5B is an enlarged cross-sectional view illustrating the packing portion at an electric wire insertion portion;

FIGS. 6A to 6C illustrate the lighting apparatus according to the embodiment installed in a showcase, wherein FIG. 6A is a vertical cross-sectional view illustrating the showcase, FIG. 6B is an enlarged partial cross-sectional view illustrating a portion where the lighting apparatus is installed on a pillar, and FIG. 6C is a perspective view illustrating the lighting apparatus attached to an attachment metal part;

FIGS. 7A and 7B illustrate a first modification according to the embodiment, wherein FIG. 7A is a perspective view illustrating a base-attached lamp, and FIG. 7B is a cross-sectional view taken along line B-B of FIG. 7A;

FIGS. 9A and 9B illustrate a third modification according to the embodiment, wherein FIG. 9A is a perspective view illustrating a connection portion, and FIG. 9B is an enlarged perspective view illustrating a portion A of FIG. 9A.

DETAILED DESCRIPTION OF THE INVENTION

Figure 1A:
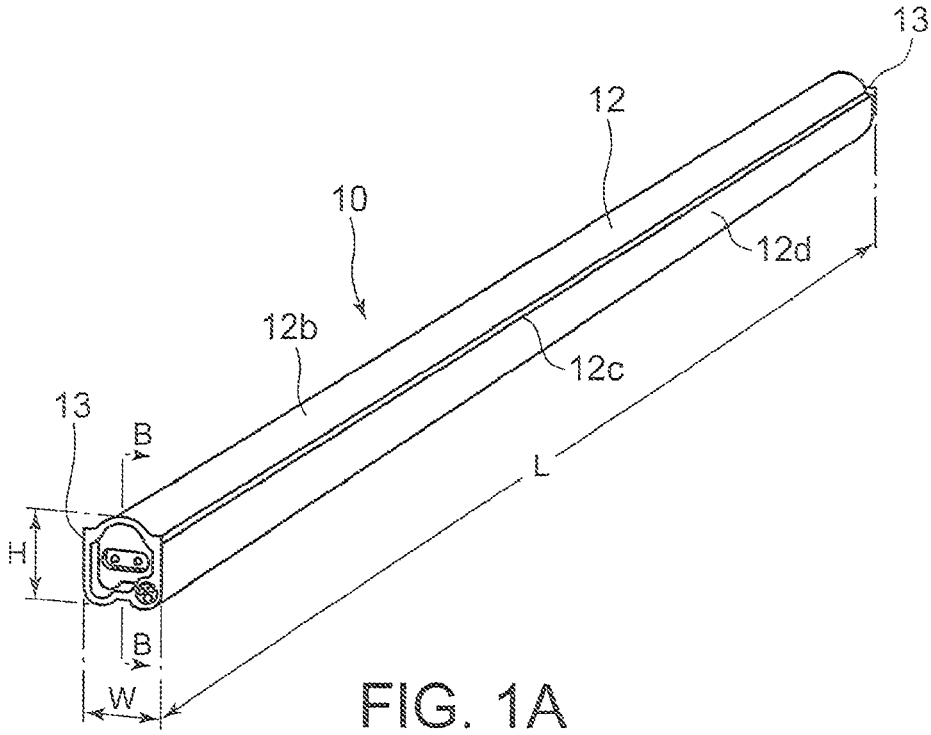

A lighting apparatus according to an exemplary embodiment of the present invention will now be described with reference to the accompanying drawings wherein the same or like reference numerals designate the same or corresponding portions throughout the several views.

In one embodiment, a lighting apparatus includes: a light source unit having light sources arranged in a longitudinal direction; a transparent cover member formed in a substantially straight pipe shape and having openings at both ends for housing the light source unit along the longitudinal direction, the cover member having a higher thermal expansion coefficient than that of the light source unit; and end plate members fixed to both ends of the light source unit and closing the openings at the both ends of the cover member.

A lighting apparatus according to this embodiment constitutes a straight pipe-shaped waterproof lighting apparatus 10 for a showcase. As illustrated in FIG. 1, the lighting apparatus 10 includes a light source unit 11 having light emitting units 11*c* with solid-state light emitting devices 11*b* arranged in a longitudinal direction of a rectangular substrate 11*a* and a light-control device 11*d* for lighting the solid-state light emitting devices 11*b*. Further, the lighting apparatus 10 includes a transparent tubular cover member 12 having openings 12*a* at both ends and a non-circular cross section, and forms a substantially straight pipe shape. It should be noted that the cover member 12 is made with a member having a thermal expansion coefficient larger than that of the light source unit 11.

Further, the openings 12*a* at both ends of the cover member 12 are closed by the end plate members 13, and the end plate members 13 are fixed to both end portions of the light source unit 11, respectively.

The light source unit 11 includes the rectangular substrates 11*a*, the light emitting unit 11*c* made of the solid-state light emitting devices 11*b* arranged along the longitudinal direction of the substrate, and the light-control device 11*d* for lighting the solid-state light emitting devices. The substrate 11*a* is made of a member having electrical insulating property. More particularly, in this embodiment, the substrate 11*a* is made of a thin tabular circuit substrate having a long and narrow rectangular shape made of glass epoxy resin. On the surface of the substrate 11*a* (the upper surface in FIG. 1B), a wiring pattern made of copper foil is formed. Further, a plurality of solid-state light emitting devices 11*b* is formed on this wiring pattern in a substantially straight line in one row with substantially the same interval.

Figure 2:
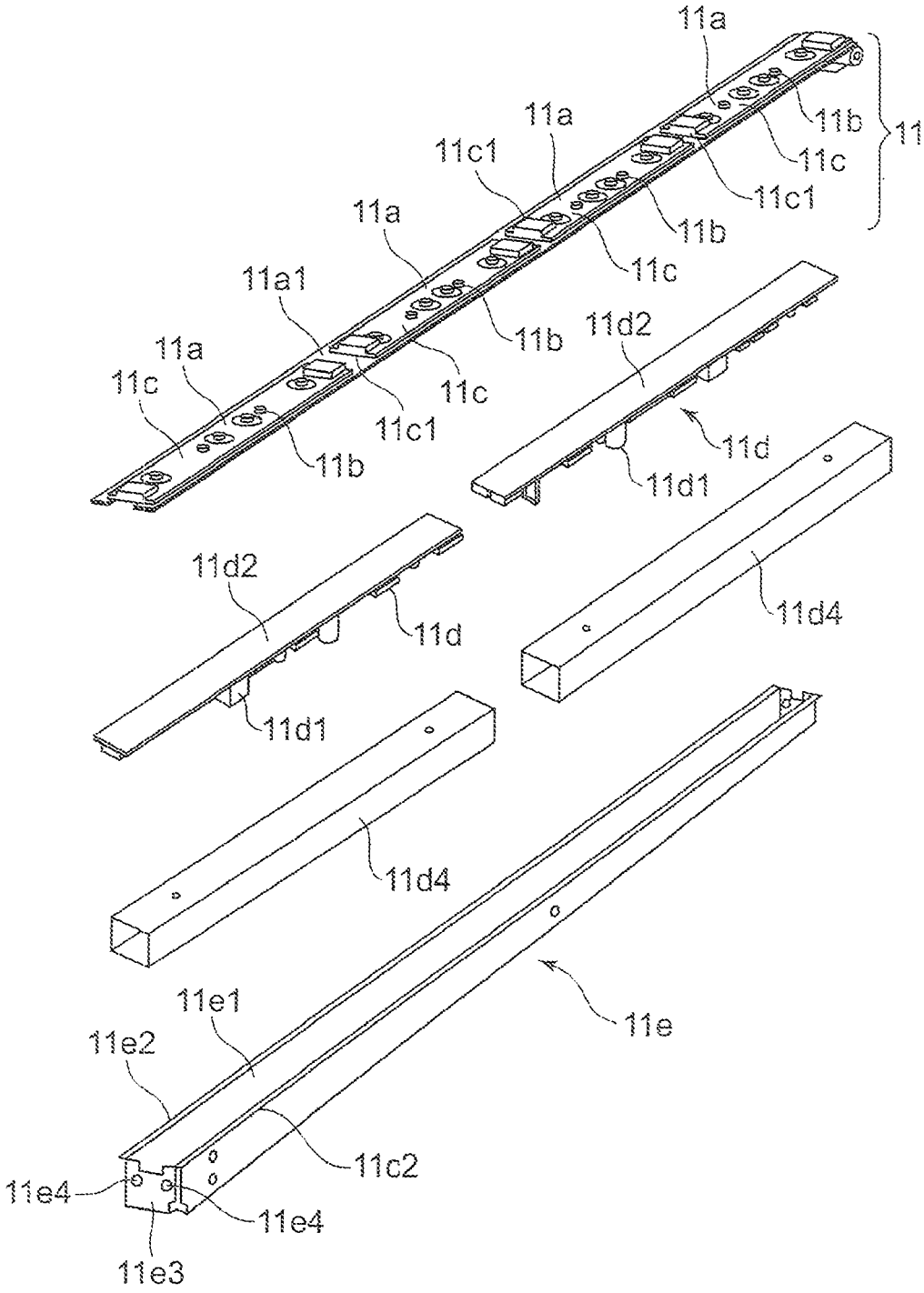
FIG. 2 is an exploded perspective view illustrating a light source unit of the lighting apparatus according to the embodiment.

As illustrated in FIG. 2, the solid-state light emitting device 11*b* includes light emitting diodes (hereafter referred to as "LEDs") in this embodiment. For example, the solid-state light emitting device 11*b* is configured by a plurality of SMD type LEDs, for example, four SMD type LEDs. The thin tabular light emitting unit 11*c* having a long and narrow shape includes these LEDs 11*b* and the substrate 11*a*, it should be noted that the four LEDs are connected in series. Further, the LED may be a COB type for emitting white light (including daylight-like white color, daylight-like color, a light bulb color) using a plurality of LED chips and fluorescent substances excited by the LED chips.

Figure 1B:
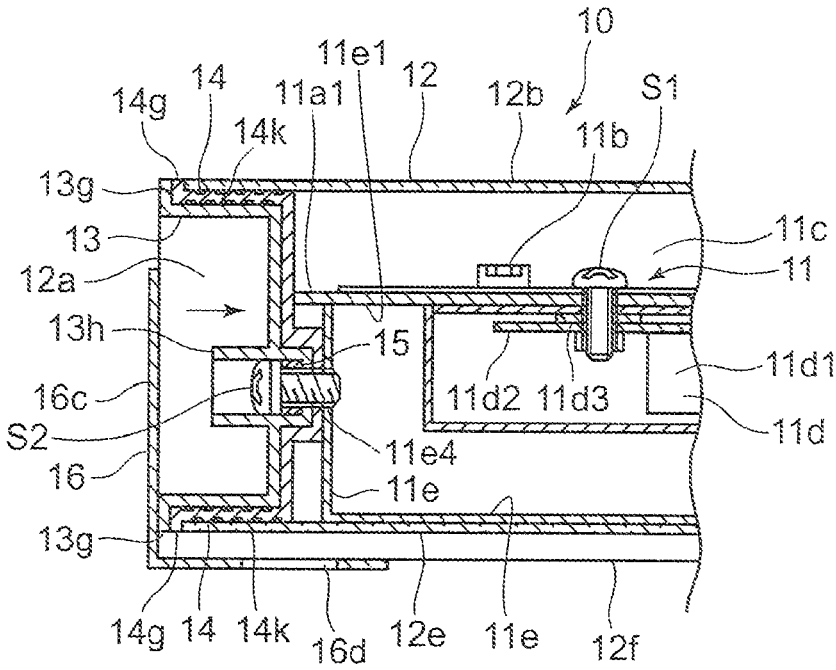

The light emitting unit 11*c* is supported by a substrate attachment plate 11*a*1. The substrate attachment plate 11*a*1 is made of a metal having thermal conductivity. In this embodiment, the substrate attachment plate 11*a*1 is made of a thin tabular copper plate having a long and narrow shape. On the surface of the substrate attachment plate 11*a*1, a plurality of light emitting units is provided. In this embodiment, four light emitting units 11*c* are provided in one row in a longitudinal direction of the substrate attachment plate 11*a*1 so that the axial lines of the light emitting units 11*c* and the substrate attachment plate 11*a*1 align each other. As illustrated in FIG. 1B, each light emitting unit 11*c* is fixed to the substrate attachment plate 11*a*1 with a screw S1. The four light emitting units 11*c* are electrically connected via connectors 11*c*1.

The light-control device 11*d* includes a lighting circuit for converting an alternating-current voltage of 100V into a direct-current voltage of 24V and providing a constant direct current to the LEDs 11*b*. The light-control device 11*d* includes an electronic component 11*d*1 constituting the lighting circuit and a circuit substrate 11*d*2 on which electronic components are mounted. Like the substrate 11*a* of the light emitting unit 11*c*, the circuit substrate 11*d*2 is made of a thin tabular rectangular glass epoxy resin having a long and narrow shape, and circuit patterns are formed on one side or both sides thereof. A plurality of small electronic components 11*d*1 is mounted on the mounting surface thereof.

As illustrated in FIG. 1B, in the circuit substrate 11*d*2 of the light-control device 11*d* having the above configuration, a portion different from the lighting emitting surface of the substrate 11*a* of the light emitting unit 11*c*, i.e., the back surface of the substrate 11*a* or the back surface of the substrate attachment plate 11*a*1 in this embodiment, is supported with a synthetic resin having electric insulating property, i.e., a spacer 11*d*3 made of PBT (polybutylene terephthalate) in this embodiment, using a screw S1 with a predetermined interval on the back surface of the substrate attachment plate 11*a*1. Using the screw S1, the substrate 11*a* of the light emitting unit 11*c* and the substrate attachment plate 11*a*1 are fixed at the same time. In the light source unit 11, an output terminal of the circuit substrate 11*d*2 constituting the light-control device 11*d* and an input terminal of the substrate 11*a* of the light emitting unit 11*c* are connected with a lead wire (not illustrated), and the light source unit 11 includes the light emitting units 11*c* and the light light-control devices 11*d* for lighting the LEDs 11*b*. Further, the light source units including the light emitting units 11*c* and the light-control devices 11*d* are arranged in the longitudinal direction. In this embodiment, two light emitting units 11*c* are driven by one light-control device 11*d*, and accordingly, four light emitting units 11*c* are driven by two light-control devices 11*d*.

As illustrated in FIG. 2, in the light source unit 11 having the above configuration, the light emitting units 11*c* face the outside, and the light-control devices 11*d* are housed within a support case 11*e*. The support case 11*e* is formed as follows. A metal having the thermal conductivity like the substrate attachment plate 11*a*1, i.e., a steel plate in this embodiment, is pressed, and an opening portion 11*e*1 is formed on the upper surface. Then, flange portions 11*e*2 are integrally formed on both ends of the opening portion, so that the support case 11*e* is made in a long and narrow box integrally formed with support end plates 11*e*3 at both ends. Two screw holes 11*e*4 are formed in the support end plates 11*e*3 at both ends so as to fix the end plate members 13, explained later.

In the box of the support case 11*e* having the above configuration, the light source unit 11 is arranged so that the longitudinal direction of the light source unit 11 is in the longitudinal direction of the box. At this occasion, the light emitting unit 11*c*, i.e., each LED 11*b*, faces outside, and the circuit substrates 11*d*2 constituting the light-control devices 11*d* are arranged to be housed in the support case 11*e*. The circuit substrate 11*d*2 constituting the light-control device 11*d* is made of a member having electric insulating property. In this embodiment, the circuit substrate 11*d*2 is covered with an insulating cover 11*d*4 made of silicone resin, so that the circuit substrate 11*d*2 is housed in such a manner that the circuit substrate 11*d*2 is electrically insulated from the metal support case 11*e*.

Further, the substrate attachment plate 11*a*1 of the light source unit 11 is formed so that the width of the substrate attachment plate 11*a*1 of the light source unit 11 is substantially the same as the distance between the flange portions 11*e*2 at both sides of the support case 11*e*. On the other hand, the substrate attachment plate 11*a*1 is formed so that the length of the substrate attachment plate 11*a*1 is substantially the same as the length of the support case 11*e*, and that the opening portion 11*e*1 of the upper surface of the support case 11*e* is closed with the substrate attachment plates 11*a*1. The substrate attachment plate 11*a*1 may be fixed onto the upper surface of the flange portions 11*e*2 at both sides of the support case 11*e* using means such as screws and adhesive agents.

Figure 3:
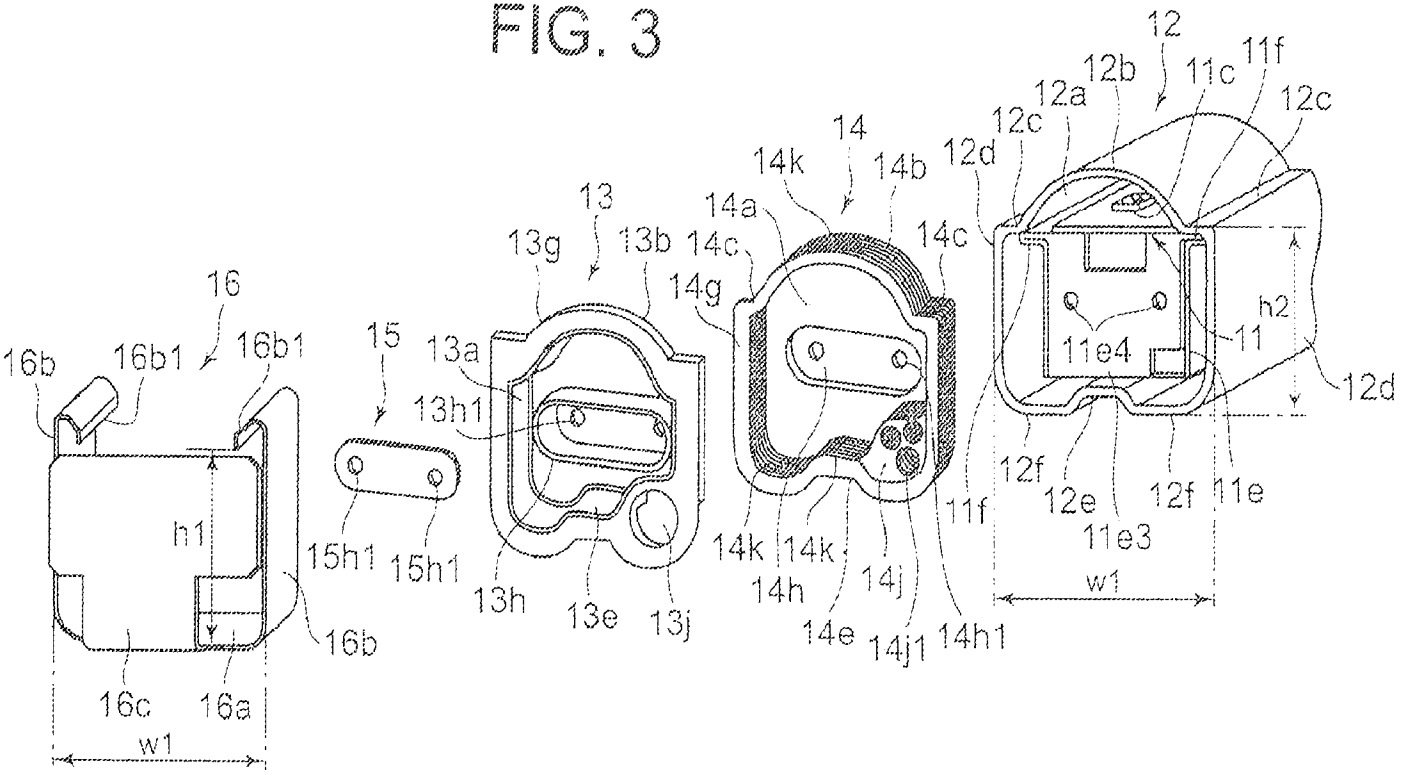
FIG. 3 is an exploded perspective view illustrating an end portion of the lighting apparatus according to the embodiment.

As described above, the light emitting units 11*c* face the outside, and the light source unit 11 is inserted and housed in the tubular cover member 12 in such a manner that the light-control device 11*d* is housed in the support case 11*e*. As illustrated in FIG. 3, the cover member 12 is made of a transparent synthetic resin having a thermal expansion coefficient larger than that of the light source unit 11. In this embodiment, the cover member 12 is made of a transparent acrylic resin, and is formed in a long tubular shape having a substantially straight pipe shape such that both ends of the cover member 12 are formed to have openings 12*a*. The cover member 12 includes a light transmitting portion 12*b* facing the light emitting unit 11*c* and having a cross section of almost a semicircular shape, both end portions 12*d* having steps 12*c* arranged at both sides of the light transmitting portion 12*b*, and a support protruding line portion 12*e* arranged on the bottom surface of the cover member 12, and an attachment portion 12*f* formed to have a substantially flat shape at both sides of the support protruding line portion 12*e*. The cover member 12 is integrally formed by resin formation so that the cross-sectional shape of the cover member 12 has a non-circular shape. The light source unit 11 is positioned by the inner surface side of the step 12*c* at each of both sides, and the outer surface side of the step 12*c* is supported by an attachment metal part 16, explained later.

Along the longitudinal direction of the cover member 12, the light source unit 11 is inserted from one of the openings 12*a* into the cover member 12 of the tubular member having the above configuration, and is housed therein. In other words, the substrate attachment plate 11*a*1 of the light source unit 11 overlaps the flange portion 11*e*2 of the support case 11*e*, whereby the upper surfaces of the protruding pieces 11*f* protruding at both sides are brought into contact with the lower surfaces of the inner surface sides of the steps 12 at both sides of the cover member 12. Further, the lower surface of the support case 11*e* is brought into contact with the support protruding line portion 12*e*. Subsequently, one end portion of the long light source unit 11 is inserted from one of the openings 12*a* of the cover member 12 while the light source unit 11 is positioned using the inner surface sides of the steps 12*c* at both sides and the upper surface of the support protruding line portion 12*e* as guides. In other words, the light source unit 11 is housed in the cover member 12 serving as a tubular member so as to be movable in the axial direction of the cover member 12, and in addition, the light source unit 11 is positionally restricted in a direction perpendicular to the axial direction. Therefore, this facilitates the assembly work, and the light source unit 11 is reliably housed in the cover member 12.

Figure 4:
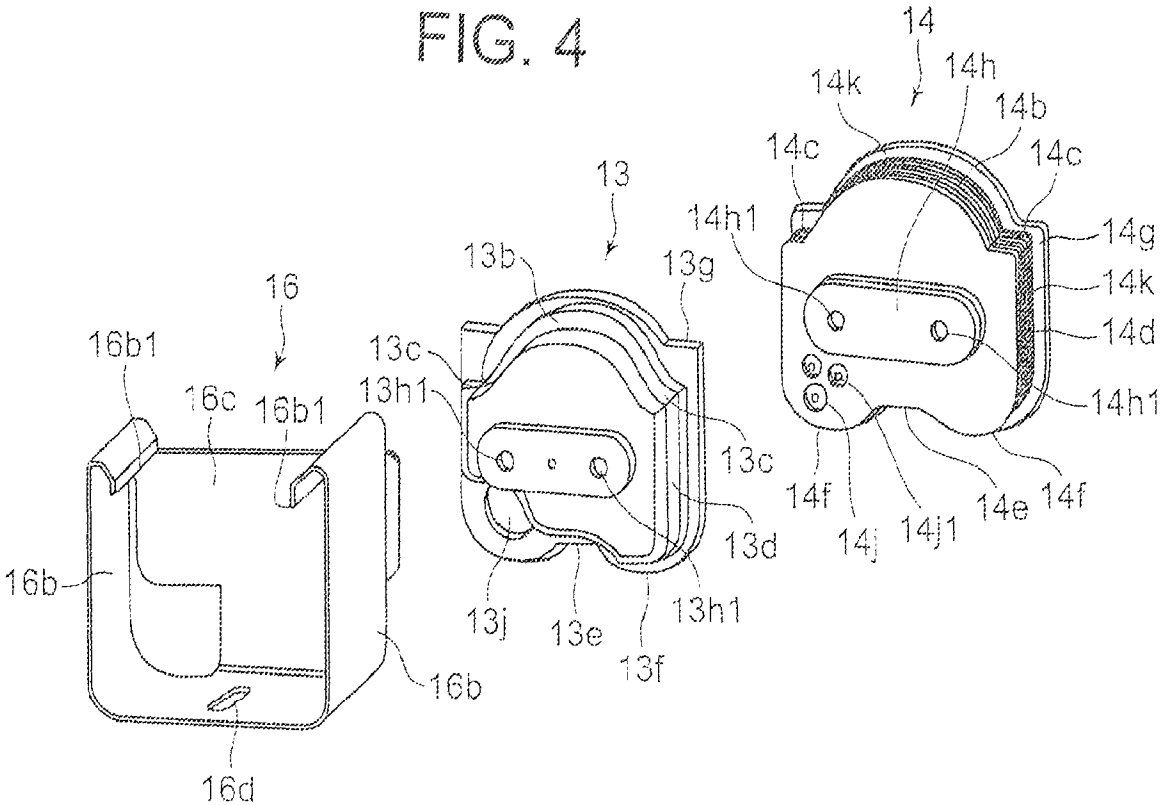
FIG. 4 is a perspective view illustrating an end plate member, a packing, a back surface of an attachment metal part of the lighting apparatus according to the embodiment.

As described above, the light source unit 11 inserted and housed in the cover member 12 is fixed such that both end portions of the light source unit 11 are fixed by the end plate members 13 closing the openings 12*a* at both ends of the cover member. As illustrated in FIGS. 3 and 4, the end plate members 13 are formed of synthetic resins having electric insulating property, PBT (polybutylene terephthalate) in this embodiment, in a cap shape having an opening 13*a* at a side. The cross-sectional shape thereof is made so that it can engage with the opening 12*a* of the cover member 12, i.e., the cross-sectional shape thereof has substantially the same external shape as the cross-sectional shape of the cover member 12 but the cross sectional shape thereof is formed in a slightly smaller external dimension. In other words, as illustrated in FIG. 4, a semicircular portion 13*b* formed at an upper surface, and both side portions 13*d* respectively having step 13*c* are formed at both sides of the semicircular portion 13*b*. A support protruding line portion 13*e* is formed on a bottom surface, and a flat portion 13*f* is formed at a side of the support protruding line portion 13*e*. The above are integrally formed with resin formation. Then, a flange portion 13*g* is integrally formed at an outer peripheral portion of the opening portion 13*a*. An elliptic packing support portion 13*h* is integrally formed to protrude in a substantially central portion on the inner bottom surface of the cap. Two insertion holes 13*h*1 are formed on the bottom surface thereof. Screws in communication with the two screw holes 11*e*4 formed in the support end plate 11*e*3 of the support case 11*e* are inserted into the two insertion holes 13*h*1. As illustrated in FIG. 4, the packing support portion 13*h* is formed to protrude also to the external surface side. In the figure, numeral 13*j* denotes an electric wire insertion hole formed at a lower corner portion of the opening portion 13*a*. Electric power lines are inserted into the insertion hole 13*j*.

As illustrated in FIG. 4, the end plate member 13 having the above configuration is fitted from one end of the opening 12*a* of the cover member 12. In this embodiment, as illustrated in FIG. 3, a packing 14 serving not only as cushion but also as insulation is interposed and fitted between the end plate member 13 and the opening 12*a* of the cover member 12. The packing 14 is formed of a flexible member. For example, in this embodiment, the packing 14 is made of silicone rubber and is formed in a cap shape having an opening 14*a* at a side. Further, the inner surface shape is formed in substantially the same external shape of the end plate member 13, and the external shape is formed in substantially the same cross-sectional shape of the cover member 12 but is formed in a slightly larger dimension. In other words, a semicircular portion 14*b* is formed at an upper surface, both side portions 14*d* having steps 14*c* are formed at both sides of the semicircular portion 14*b*, and a support protruding line 14*e* is formed on a bottom surface. Further, a flat portion 14*f* is formed at a side of the support protruding line 14*k*. The above are integrally formed with formation steps. Then, a flange portion 14*g* is integrally formed at an outer peripheral portion of the opening portion 14*a*. An elliptic packing support portion 14*h* is integrally formed to protrude in a substantially central portion on the inner bottom surface of the cap. Two insertion holes 14*h*1 for screwing are formed on the bottom surface thereof so as to communicate with the two insertion holes 13*h*1 formed in the packing support portion 13*h* of the end plate member 13. It should be noted that the packing support portion 14*h* is formed to protrude to the external surface side.

Figure 5A:
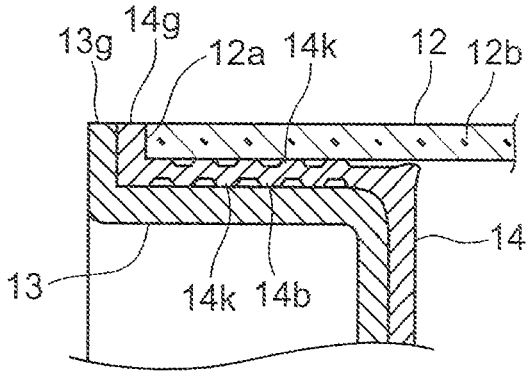
Figure 5B:
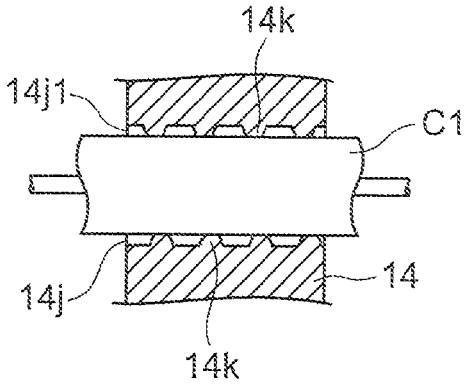

As illustrated in FIGS. 5A and 5B, numeral 14*j* in the figures denotes an electric wire packing formed in the packing 14 so as to be in close contact with the electric wire insertion hole 13 corresponding to the electric wire insertion hole 13*j* of the end plate member 13, and three electric wire sealing holes 14*j*1 are formed through which two power source lines and one earth line are inserted. A plurality of protruding line portions 14*k* is integrally formed in a circumferential direction on the inner surface and the outer surface of the packing 14. A plurality of protruding line portions 14*k* is integrally formed on the inner surface in a circumferential direction of the three electric wire sealing holes 14*j*1 of the electric wire packing portion 14*j*. In figure, numeral 15 denotes a screw packing having an elliptic thin plate shape made of silicone rubber. The screw packing 15 is engaged with the elliptic packing support portion 13*h* of the end plate member 13 in such a manner to be in close contact with the elliptic packing support portion 13*h* of the end plate member 13. This screw packing 15 is formed with two insertion holes 15*h*1 in communication with two insertion holes 13*h*1 of the end plate member 13.

The end plate member 13, the packing 14, and the screw packing 15 configured as described above are provided in pairs so as to correspond to the openings 12*a* of both right and left ends of the cover member 12, and are fixed to both end portions of the light source unit 11 inserted and housed in the cover member 12. This fixing structure is the same both at the right and left ends. In the explanation below, the structure at the left will be explained as illustrated in FIG. 1A.

First, the inner peripheral portion of the packing 14 is fitted into the outer peripheral portion of the end plate member 13. At this occasion, as illustrated in FIG. 5A, the plurality of protruding line portions 14*k* is formed on the internal surface of the packing 14 in a circumferential direction, and accordingly, when the protruding line portions 14K are bent due to the elasticity of the packing 14, the outer peripheral portion of the end plate member 13 and the inner peripheral portion of the packing 14 are engaged with each other and in close contact with each other in an air tight manner. At the same time, the surface of the electric wire packing 14*j* of the packing 14 is in close contact with the back surface side of the electric wire insertion hole of the end plate member 13 in an air tight manner due to the elasticity of the packing. The two insertion holes 13*h*1 of the end plate member 13 are in communication with the two insertion holes 14*h*1 of the packing 14. Further, while the packing 14 is engaged with the end plate member 13, the peaks (outer peripheral portions) of the flange portions 13*g*, 14*g* thereof are protruded therefrom in a flush state.

As described above, the packing 14 is engaged with the end plate member 13, and the integrated members are fitted into the openings 12*a* at both ends of the tubular cover member 12 for housing the light source unit 11 which is inserted in advance. This engagement is done as follows. The outer peripheral portion of the packing 14 fitted to the outer peripheral portion of the end plate member 13 is engaged with the opening 12*a* of the cover member 12 and is fitted therein. At this occasion, as illustrated in FIG. 5A, the outer peripheral surface of the packing 14 is formed with the plurality of protruding line portions 14*k* in a circumferential direction, and accordingly, when the protruding line portions 14K are bent due to the elasticity of the packing, the outer peripheral portion of the packing 14 and the inner peripheral portion of the cover member 12 are engaged with each other and in close contact with each other in an air tight manner. At the same time, the electric wire insertion hole 13*j* of the end plate member 13 is in communication with the electric wire sealing hole 14*j*1 of the packing 14. Further, the outer peripheral portion of the flange portion 13*g* of the end plate member 13 and the flange portion 14*g* of the packing 14 are flush with each other and are protruding therefrom, and are in close contact with the end surface of the opening 12*a* of the cover member 12. The outer peripheral portions of the flange portions 13*g* of the end plate member 13 and the flange portion 14*g* of the packing 14 are flush with the outer surface of the cover member 12, which improves the external appearance.

Subsequently, the screw packing 15 is engaged with the packing support portion 13*h* of the end plate member 13. In this time, the two insertion holes 15*h*1 of the screw packing 15, the two insertion holes 13*h*1 of the end plate member 13, and the two insertion holes 14*h*1 of the packing 14 are in communication with each other. Further, the light source unit 11 is positioned using the inner surface sides of the steps 12*c* at both sides as guides. In other words, the light source unit 11 is positionally restricted in a direction perpendicular to the axial direction of the cover member 12. Therefore, many insertion holes and the two screw holes 11*e*4 are in a positioned state.

In this state, two screws, tapping screws S2 in this embodiment, are inserted into the two insertion holes 15*h*1 of the screw packing 15, then screwed and fixed in the screw holes 11*e*4 of the support end plate 11*e*3 of the light source unit 11 via the respective insertion holes 13*h*1, 14*h*1 of the end plate member 13 and the packing 14. The above screwing process is performed to the end plate member 13 engaged with the opening 12*a* at each of both right and left sides. When the screws are fixed as above, the end plate member 13 and the packing 14 at each of both right and left sides are pressed toward the support end plate 11*e*3 (arrow direction in FIG. 1B). When the end plate member 13 and the packing 14 are pressed, the flange portion 14*g* of the packing 14 is sandwiched between the flange portion 13*g* of the end plate member 13 and the end surface of the opening 12*a* of the cover member 12, whereby the packing 14 is compressed against its elasticity, and the packing 14 is in close contact in an air tight manner.

The cover member 12 is configured to have a non-circular cross sectional shape, and the shape of the inner peripheral surface is formed to have a smoothly continuous surface. Accordingly, the protruding line portions 14*k* on the outer peripheral surface of the packing 14 is deformed according to the shape of the inner peripheral surface of the cover member 12 due to its elasticity, so that the air tightness is more reliably maintained.

The tubular cover member 12 is made of a synthetic resin having a high thermal expansion coefficient, but component parts of the light source unit 11 such as the support case 11*e* are made of metal. Therefore, there is a difference between the thermal expansion coefficient of the cover member 12 and the thermal expansion coefficient of the light source unit 11. Depending on the temperature of use environment, the cover member 12 made of acrylic resin having a high thermal expansion coefficient expands or shrinks more greatly than the light source unit 11, and as a result, the length of the long and narrow straight pipe-shaped cover member 14 changes.

In this embodiment, however, the air tightness is maintained even when the length of the cover member changes. More specifically, when the cover member expands due to heat, the length of the cover member 12 slightly increases. However, the expansion is sufficiently absorbed by the expansion and shrinking of the packing 14 due to its elasticity, and higher degree of air tightness is attained. For example, even when the lighting apparatus is used as an illumination in a refrigerator and the like in which the temperature is about −25° C., and the cover member 12 shrinks and the length thereof decreases, the flange portion 14*g* of the packing 14 sufficiently keeps track of the cover member 12 due to the elasticity of the packing 14 and recovers with its elasticity, whereby a close contact state is maintained.

Further, as described above, in the light source unit 11, the upper surfaces of the protruding pieces 11*f* are in contact with the inner surface sides of the steps 12*c* of the cover member 12, and the lower surface of the support case 11*e* is brought into contact with the support protruding line portion 12*e*. The light source unit 11 is positioned and housed using them as guides. In other words, the light source unit 11 is supported and fixed only by the end plate member 13, and is not fixed to the cover member 12, i.e., tubular member. The cover member is supported by the end plate member so as to be movable with respect to the light source unit 11 in the longitudinal direction, and the light source unit 11 is positioned in a perpendicular direction with the longitudinal direction by the cover member 12.

Therefore, even when the cover member 12 made of resin expands or shrinks due to heat, stress caused by expansion and shrinking is less likely to be transmitted to the light source unit 11, and the light source unit 11 is less likely to be affected. At the same time, vibration and shock transmitted from the cover member 12 is absorbed by the packing 14 also which serves as a vibration/shock absorbing member, and accordingly, the vibration and shock is less likely to be transmitted to the light source unit 11. Therefore, the vibration/shock resistant lighting apparatus can be made.

As described above, the flange portion 14*g* of the packing 14 and the flange portion 13*g* of the end plate member 13 are brought into close contact with each other by the packing in an air tight manner, and at the same time, the electric wire insertion holes 13*j* of the end plate member 13 are pressed against the electric wire packing 14*j* of the packing 14, whereby the electric wire insertion portion is in close contact in an air tight manner. Further, the heads of the two tapping screws S2 are pressed against the surface of the screw packing 15, whereby the screw insertion portion is in close contact in an air tight manner.

Figure 6A:
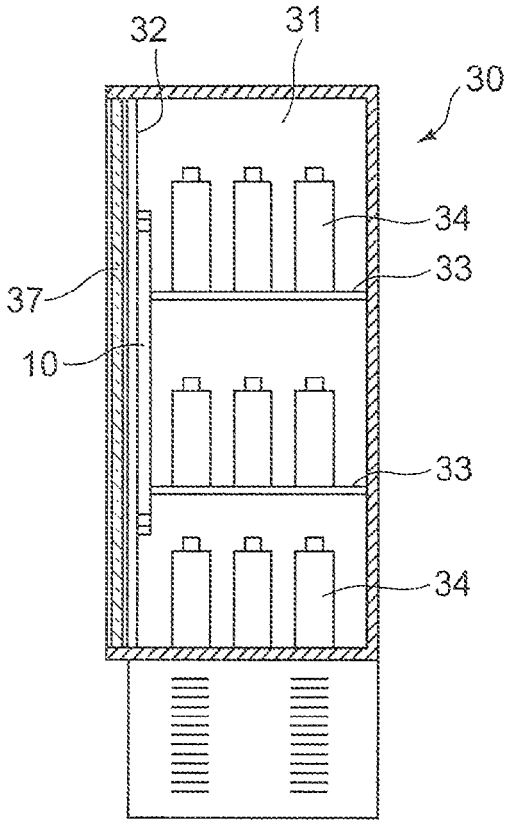
Figure 6B:
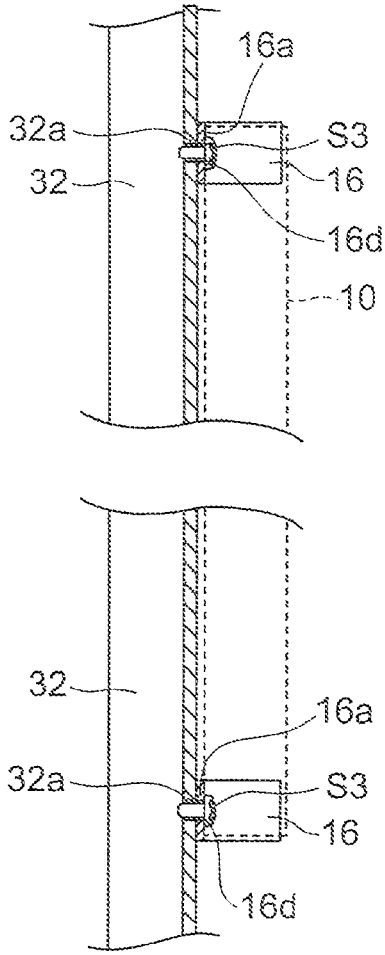
Figure 6C:
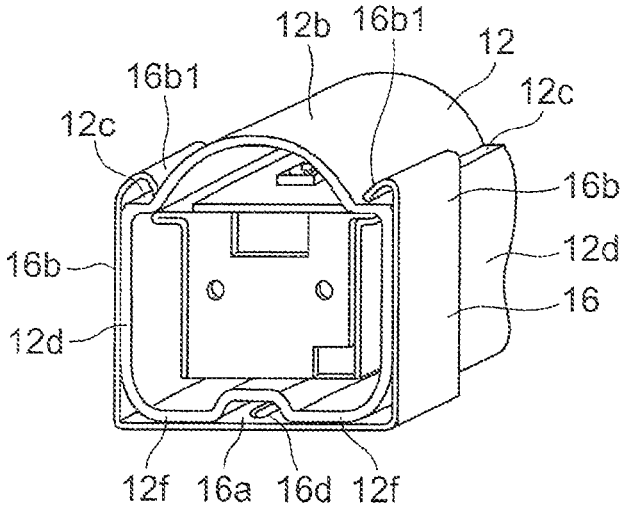

Therefore, as illustrated in FIG. 6, both end portions of the light source unit 11 are brought into close contact with the openings 12*a* at both ends of the cover member 12 each other by the end plate member 13 and the packing 14 in an air tight manner. As a result, the straight pipe-shaped waterproof lighting apparatus 10 for showcase or refrigerator can be made. In this embodiment, the lighting apparatus has a length L of about 1200 mm, a width W of about 37 mm, and a height H of about 39 mm, which is a long and narrow lighting apparatus. In the figure, numeral 16 denotes an attachment metal part for installing the lighting apparatus 10 having the above configuration in an installation portion, i.e., a showcase in this embodiment. The attachment metal part 16 is made by pressing a member having a certain level of rigidity but capable of applying spring property, i.e.; stainless in this embodiment. As illustrated in FIG. 6C, the attachment metal part 16 includes a flat base portion 16*a*, a pair of support pieces 16*b* applying spring property formed by bending both end portions of the base portion 16*a* in a substantially vertical direction, and a cover portion 16*c* rising in a substantially vertical direction from the base portion 16*a*. The base portion 16*a* has an elongated insertion hole 16*d* into which fixing screws are inserted. A fixing piece 16*b*1 is integrally formed by inwardly bending an upper end portion of each of the pair of support pieces 16*b*. The pair of support pieces 16*b* is formed so that a clearance w1 between the pair of support pieces 16*b* is substantially the same as a width W2 of the cover member 12 (W1≈W2). A height h1 to the fixing piece 16*b*1 of each of the pair of support pieces 16*b* is slightly lower than a height h2 to the step 12*c* of the cover member 12 (h1<h2) so as to get elasticity. In the above configuration, two attachment metal parts 16 having the above configuration are prepared so that they are fixed to both of the right and left end portions of the cover member 12.

The lighting apparatus 10 having the above configuration is installed in a showcase as follows. As illustrated in FIGS. 6A to 6C, numeral 30 denotes a double-door showcase for cooling and storing beverages and the like. The lighting apparatus 10 having the above configuration is installed on a back surface side of a pillar 32 located at a joint of double doors 31. The pillar 32 is formed with two installation screw holes 32*a* in a vertical direction in advance. Into this screw holes, screws S3 are inserted and fixed by aligning the screws S3 with insertion holes 16*d* formed in base portions 16*a* of the attachment metal part 16. At this occasion, the installation positions of the attachment metal parts 16 are adjusted using elongated hole dimensions of the insertion holes 16*d*, and the dimension between the two upper and lower attachment metal parts is adjusted according to the length of the lighting apparatus 10.

As described above, the lighting apparatus 10 is fixed to the attachment metal parts 16 fixed to the pillar 32. First, as illustrated in FIG. 6C, the attachment unit 12*f* of the cover member 12 is inserted into the space between the pair of support pieces 16*b* of the attachment metal part 16 while pushing and expanding the support pieces 16*b* against the spring force applied by the pair of support pieces 16*b*, and the flat attachment portion 12*f* of the cover member 12 is brought into contact with the flat base portion 16*a* of the attachment metal part 16.

With this inserting operation, the fixing piece 16*b*1 of each of the support pieces 16*b* moves along the both side portions 12*d* of the cover member 12 while the fixing piece 16*b*1 is bent, and the fixing piece 16*b*1 is dropped into the upper surface of the step 12*c* of the cover member due to the spring property of the support pieces 16*b*. As a result, the fixing piece 16*b*1 is engaged on the outer surface of the step 12*c* of the cover member due to the elastic force of the spring property, and the lighting apparatus 10 is fixed in the vertical direction, i.e., the longitudinal direction of the pillar 32. When the lighting apparatus 10 is detached, the steps opposite to the above are taken. The support pieces 16*b* are pressed and opened with fingers and the like, whereby the fixing piece 16*b*1 is disengaged from the step 12*c*, and the lighting apparatus 10 can be pulled from the support pieces 16*b*1.

The power source lines are connected to the light source units 11 of the lighting apparatus 10 before the lighting apparatus is installed. More specifically, the electric wire drawn from the pillar 32, i.e., a Cabtyre cable C1 having a circular cross section in this embodiment, are connected in advance. The Cabtyre cable C1 includes totally three electric wires including two power source lines and one earth line. These wires are inserted into the electric wire sealing holes 14*j*1 formed in the packing 14 of the lighting apparatus 10, and are connected to the input terminal of the light source unit 11.

At this occasion, as illustrated in FIG. 5B, the plurality of protruding line portions 14*k* is formed in the inner surface of the electric wire sealing hole 14*j*1 in the circumferential direction, and the protruding line portions 14K come into close contact with the surface of the wire C1 due to its elasticity, whereby air tightness is maintained in the electric wire insertion portion. When the cable wire is connected, the end plate member 13 and packing 14, which are integrated, are detached from the light source unit 11. After the electric wire is connected, the end plate member 13 and packing 14 are fixed to the light source unit 11 again to close the openings 12*a* of the cover member 12. In the figure, numeral 33 denotes shelves installed at upper and lower levels in the showcase 30. Numeral 34 denotes beverages such as plastic bottles placed and displayed on each shelf.

As described above, when the lighting apparatus 10 installed at the back surface side of the door 31 is turned on, each LED 11*b* of the light emitting units 11*c* in the light source unit 11 is turned on so that each LED 11*b* emits light. The light emitted from the LEDs passes through the light transmitting portion 12*b* having a semicircular cross section in the cover member 12, and the light is emitted substantially in a distribution direction of LEDs. Accordingly, the light expands in the horizontal direction from each LED 11*b* arranged in the vertical direction, and beverages and the like displayed on the shelves installed in the vertical direction can be illuminated substantially uniformly in a vertical direction. When dew and spilled water generated in the showcase drop on the lighting apparatus 10, no water enters into the lighting apparatus 10 according to this embodiment because the packings 14, 15 maintain air tight closing between the end plate member 13 and the cover member 12, the screw insertion portions, and the electric wire insertion portions. Moreover, neither trash nor dust enters into the lighting apparatus 10.

The heat generated by each LED 11*b* is radiated to the cover member 12 from the substrate attachment plate 11*a*1 made of a steel sheet, and this prevents the increase in the temperature of the LEDs. The heat generated by the electronic components 11*d*1 of the light-control device 11*d* is also radiated from the support case 11*e* made of a steel plate to the cover member 12, and this prevents the increase in the temperature of the electronic components. In the above case, the lighting apparatus 10 is made as a lighting apparatus newly installed in a showcase. Alternatively, the lighting apparatus 10 according to this embodiment may be substituted for fluorescent lamp lighting apparatuses already installed in showcases, so that further power saving and longer life can be attained.

As described above, in this embodiment, the lighting apparatus 10 is installed vertically in the double-door showcase 30. Alternatively; the lighting apparatus 10 may be installed horizontally. Still alternatively, the lighting apparatus 10 can be applied to not only the showcase but also, for example, illumination for a parking fee collecting machine in a parking lot installed outdoors. In this case, even when the lighting apparatus 10 is installed outdoors and exposed to weather, the lighting apparatus prevents entry of water such as rain and entry of trash and dust in the same manner. This embodiment can be applied to not only the above listed exemplary uses but also various other kinds of lighting apparatuses used for business and in facilities such as homes, shops, and offices.

Figure 7A:
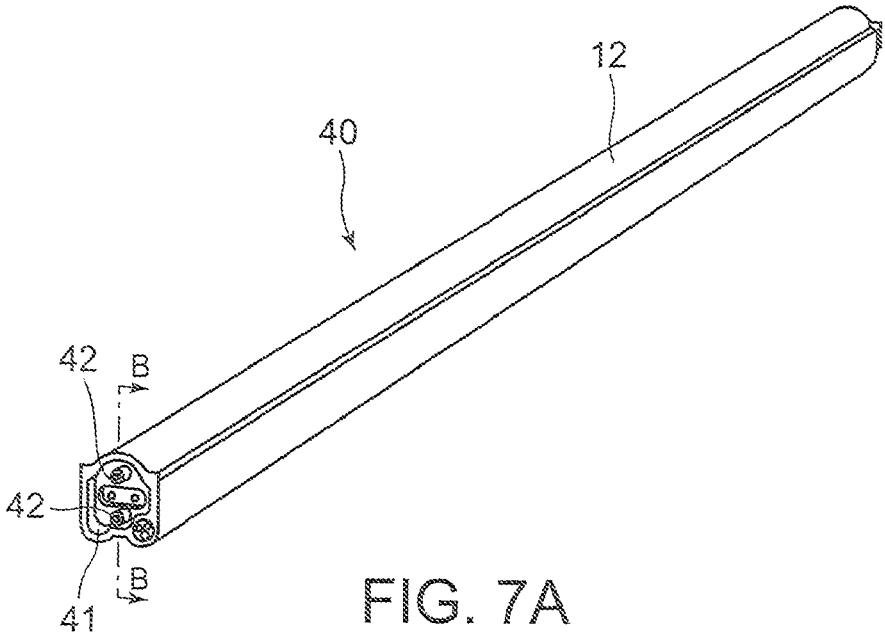
Figure 7B:
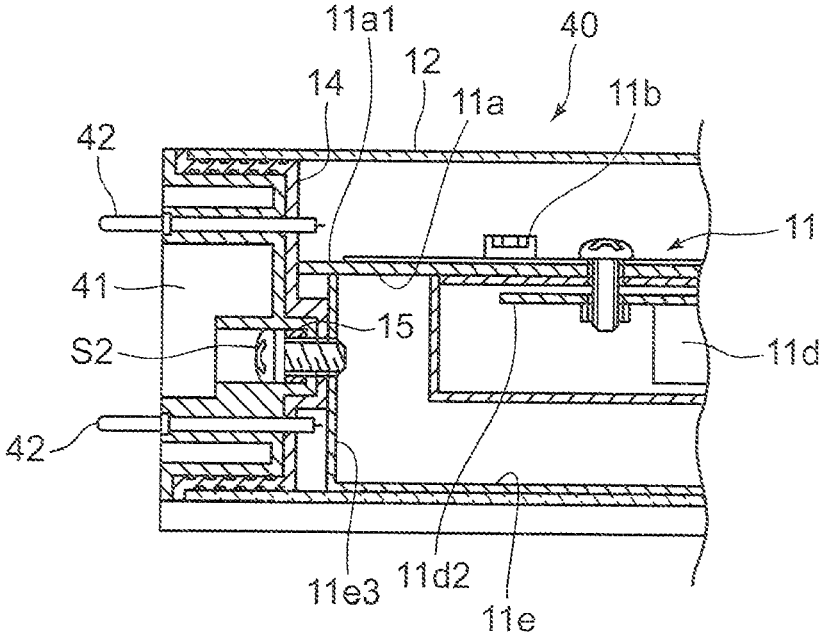

Further, in the above explanation, the lighting apparatus is made. Alternatively, a base-attached lamp may be made. As illustrated in FIG. 7, numeral 40 denotes a base-attached lamp having a straight pipe shape wherein a base material 41 is arranged at one end portion of the cover member 12. The base member 41 is made by resin formation in which a pair of base pins 42 are integrally attached to an end of the end plate member 13 made of electrically insulating resin as described-above. One end of the base pin 42 is electrically connected via a lead wire to the input terminal of the light source unit 11, and the other end of the base pin 42 is configured to protrude from one end of the end plate member 13 to the outside.

In this structure, the lighting apparatus according to this embodiment includes the light-control device 11*d*. Therefore, for example, a base-attached lamp 40 can be provided. The base-attached lamp 40 has the same structure as a socket of a generally-available fluorescent lamp, and it can be turned on by just inserting the base pin 42 according to this modification into a fitting terminal of a socket connected to a power source.

In this embodiment, the solid-state light emitting device is made of LED. Alternatively, other solid-state light emitting devices such as semiconductor laser and organic EL may be employed. In this embodiment, the solid-state light emitting device is linearly implemented on a long and narrow rectangular substrate. Alternatively, many solid-state light emitting devices may be arranged in matrix form, staggered form, radiating form, and the like, in such a manner that all of the solid-state light emitting devices are arranged and implemented on a surface with a certain order according to a rule.

In this embodiment, four light emitting units 11*c* are used to make the light source unit 11. Alternatively, light source units 11*c* may be made by making the light emitting unit 11*c* and the light-control device 11*d* into a module having a length of, e.g., about 600 mm and appropriately selecting the number of modules, so that various kinds of lighting apparatuses having lengths suitable for purposes can be obtained.

Figure 8:
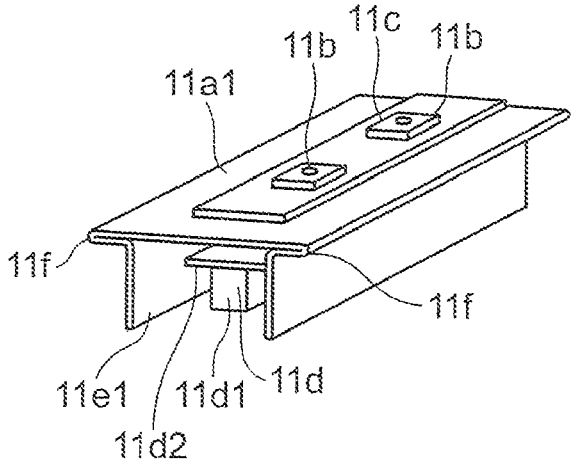
FIG. 8 is a perspective view illustrating a second modification according to the embodiment.

In this embodiment, the substrate attachment plate 11*a*1 on which the light emitting units 11*c* are arranged is made of a flat plate, and the support case 11*e* housing the light-control device 11*d* has a box shape. On the contrary, as illustrated in FIG. 8, the substrate attachment plate 11*a*1 may have a box shape, and the light emitting units 11*c* may be provided on the outer surface of the box, and the light-control device 11*d* may be housed in the box.

The cover member 12 may be semitransparent such as milky-white color so as to diffuse light. Alternatively; the cover member 12 may be made of transparent or semitransparent glass. Further, the cover members may be dyed in blue, red, or the like.

The substrate 11*a* and the circuit substrate 11*d*2 of the light-control device 11*d* are made of glass epoxy resin. Alternatively, they may be made of ceramics and metal such as aluminum having a high thermal conductivity. The substrate attachment plate 11*a*1 and the support case 11*e* are made of steel plates. Alternatively, the substrate attachment plate 11*a*1 and the support case 11*e* may be made by aluminum die casting having a high thermal conductivity, so as to achieve more effective radiation effect.

The attachment metal part 16 may be configured to have a function of connecting a plurality of lighting apparatuses, in other words, as illustrated in FIG. 9, the size of the attachment metal part 16 is increased in the longitudinal direction, and the cover portion 16*c* is removed, so that a pair of base portions 16*a* whose both ends are open are formed, and an integrally-formed wide support piece 16*b* is formed by integrally connecting substantially half of open surface sides of the pair of base portions facing each other. A pair of grooves 16*e* is formed at a substantially intermediate portion in a longitudinal direction and at a joint between the support piece 16*b* and the fixing piece 16*b*1. When the lighting apparatus 10 is inserted, these grooves 16*e* are engaged with both corner portions at a lower side of the flange portion 13*g* of the end plate member 13 made of resin, and this prevents displacement of the apparatus in the horizontal direction, and positions each of the connected lighting apparatus. Accordingly, four grooves 16*e* are provided in such a manner that two grooves 16*e* are provided for each connected lighting apparatus so as to face each other and be spaced from each other.

The attachment metal part 16 having the above configuration can be used to connect and install a plurality of lighting apparatuses as follows. First, an end portion of one of connected lighting apparatuses 10A is supported using a wider supporting piece 16*b* of the attachment metal part 16. Then, both corner portions at a lower side of the flange portions 13*g* of the end plate member 13 of the lighting apparatus 10A are engaged with the groves 16*e*, so that it is positioned in the horizontal direction, i.e., the longitudinal direction. Subsequently, likewise, the other of the lighting apparatuses 10B is supported using the other support piece 16*b* of the attachment metal part 16. Then, both corner portions at a lower side of the flange portions 13*g* of the end plate member 13 of the lighting apparatus 10B are engaged with the gloves 16*e*, so that it is positioned in the longitudinal direction.

Figure 9A:
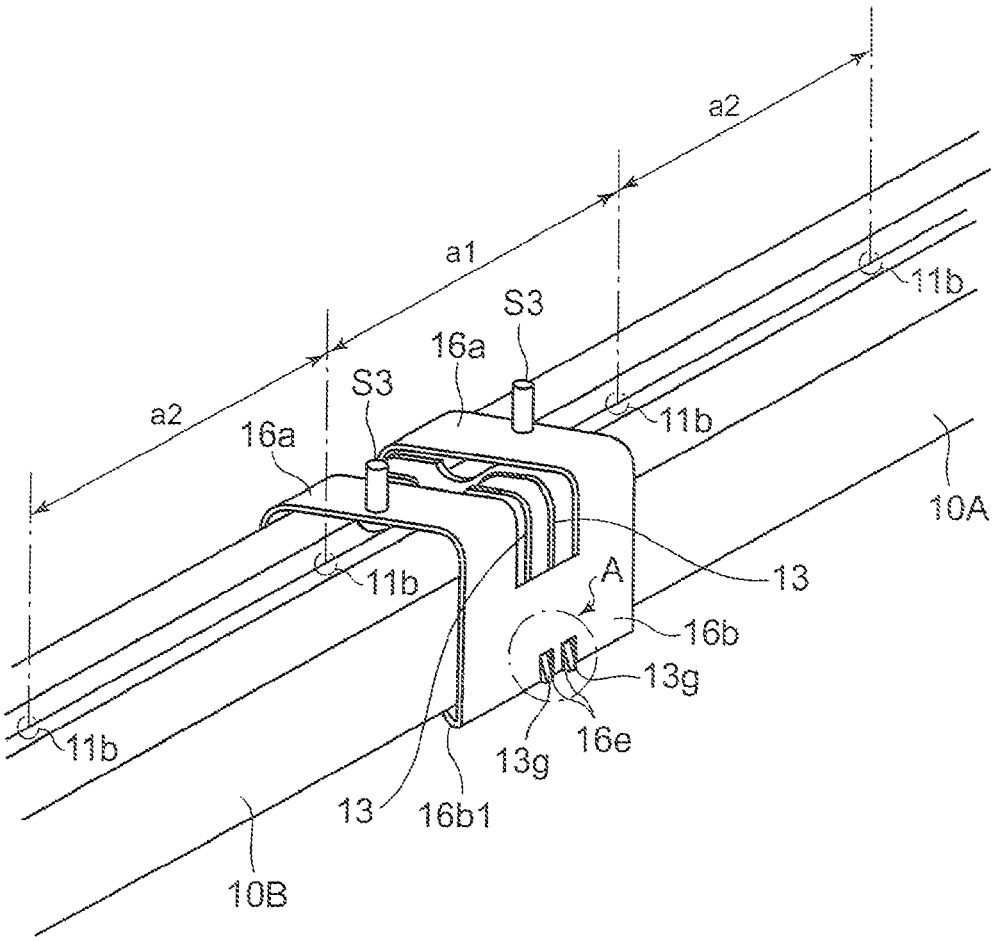
Figure 9B:
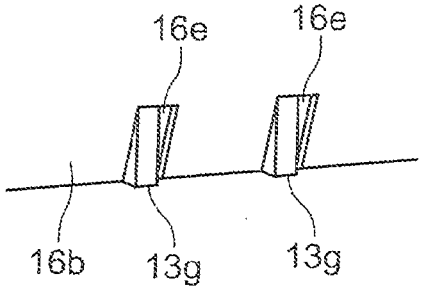

As a result, the two lighting apparatuses 10A, 10B are connected by the attachment metal part 16 with a minimum clearance at the connection portion, and the two lighting apparatuses 10A, 10B are connected in such a manner that they appear to be one continuous long lighting apparatus. When three lighting apparatuses are connected, one more attachment metal part having the above configuration may be prepared, and the lighting apparatus can be connected in the same manner. As described above, when the necessary number of attachment metal parts having the above configuration are prepared, the necessary number of lighting apparatuses can be easily connected. It should be noted that the attachment metal part 16 is connected while it is already fixed to an installation location in advance as described-above. In FIGS. 9A and 9B, numeral S3 denotes screws inserted via the insertion holes 16*d* formed in the base portion 16*a* into the installation portion.

According to the above configuration, the attachment metal part 16 can easily connect a plurality of lighting apparatuses, and at the same time, the plurality of lighting apparatuses can be easily installed to the installation portion. Moreover, since the lighting apparatuses can be positioned and connected using the grooves 16*e*, an installation interval (pitch) a1 of the LEDs 11*b* of the lighting apparatuses adjacent to each other at the connection portion can be configured to be the same as a pitch a2 of each apparatus as illustrated in the figure (a1≈a2). Accordingly, the installation interval between the light emitting units of the plurality of connected lighting apparatuses becomes substantially the same, and the clearance at the above connection portion is reduced to the minimum. For these reasons, one continuous lighting apparatus is formed to emit uniform light in the longitudinal direction.

As described above, according to this embodiment, the cover member 12, i.e., tubular member, houses the light source unit 11 in such a manner that the light source unit 11 can move in the axial direction and the light source unit 11 is positionally restricted in the direction perpendicular to the axis. Moreover, the light source unit 11 is supported by the end plate members 13. As a result, it becomes possible to supply the lighting apparatus such as a base-attached lamp and a lighting apparatus that can be assembled without any problem even when materials having different thermal expansion coefficients are used.

Further, the tubular cover member 12 is made of synthetic resin having a high thermal expansion coefficient, and main components of the light source unit 11 such as the substrate attachment plate 11*a*1 are made of metal. Therefore, the cover member 12 made of acrylic resin having a high thermal expansion coefficient expands or shrinks more greatly than the light source unit 11, which changes the length of the cover member 12. In this embodiment, however, the light source unit 11 is fixed to only the end plate member 13 but is not fixed to the cover member 12. In other words, the cover member 12 houses the light source unit 11 in such a manner that the light source unit 11 can move in the axial direction of the cover member 12 and that the light source unit 11 is positionally restricted in the direction perpendicular to the axis. Since the light source unit 11 is supported by the end plate member 13, even when the resin cover member 12 expands or shrinks due to heat, stress of expansion and shrinking is not applied to the light source unit 11, and the light source unit is less likely to be affected. Further, the lighting apparatus is less likely to cause malfunction due to temperature even under harsh use environment. Still further, since the packing 14 absorbs vibration and shock transmitted from the cover member 12, the vibration and shock are less likely to be transmitted to the light source unit 11. Therefore, the vibration/shock resistant lighting apparatus can be made. Even when the length of the cover member, i.e., tubular member, changes, the change is sufficiently absorbed by the elastic force of the packing 14 having shock absorbing function. The lighting apparatus can be provided that can sufficiently ensure the air tightness and waterproof property.

The cover member 12 has a semicircular cross section, and the shape of the inner peripheral surface is formed to have a smoothly continuous surface. Accordingly, the packing 14 is deformed according to the shape of the inner peripheral surface of the cover member due to its elasticity, so that the air tightness is more maintained. Therefore, more reliable waterproof property can be ensured. Since the cover member 12 has a semicircular cross section, the bottom surface of the attachment portion 12*f* can be flat, and the flat attachment portion 12*f* can be brought into close contact with the flat base portion 16*a* of the attachment metal part 16, so that the cover member can be reliably attached to the attachment metal part 16. At the same time, the orientation of the apparatus can be easily determined.

The inner surface of step 12*c* of the cover member 12 is configured to be used to position the light source unit 11, and the outer surface of step 12*c* is configured to be supported by the attachment metal part 16. Therefore, one end portion of the long light source unit 11 can be inserted from one of the openings 12*a* of the cover member 12. In addition, this facilitates the assembly work, and the light source unit 11 can be reliably attached to the cover member 12.

While certain embodiments have been described, these embodiments have been used by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lighting apparatus, comprising:

a light source unit including a plurality of light emitting units arranged in a longitudinal direction of the light source unit;

a transparent cover member formed in a substantially straight tubular shape defining an interior space and having openings at both ends, the cover member housing the light source unit along the longitudinal direction of the light source unit, the cover member having a higher thermal expansion coefficient than a thermal expansion coefficient of the light source unit; and a plurality of end plate members, each end plate member being fixed to one of the ends of the light source unit and closing the opening at the end of the cover member to which the end plate member is fixed;

wherein the light source unit is accommodated in the interior space of the cover member, and the light source unit contacts an inner surface of the cover member.

2. The lighting apparatus according to claim 1, wherein the cover member is supported by the end plate member so as to be movable with respect to the light source unit in the longitudinal direction, and the light source unit is positioned in a direction perpendicular to the longitudinal direction by the cover member.

3. The lighting apparatus according to claim 1, wherein the cover member has a non-circular cross-sectional shape.

4. The lighting apparatus according to claim 1, wherein the cover member includes:

a light transmitting portion facing the light emitting units and having a substantially semi-circular cross-sectional shape;

a fixing portion formed at a bottom surface of the cover member and having a substantially flat shape; and a plurality of attachment parts;

wherein both ends of the cover member include a step disposed adjacent to an end of the light source unit nearest the end of the cover member, the steps substantially fixing a position of the light source unit, and wherein the light source unit is supported by one of the attachment parts at one of the ends of the light source unit and supported by another one of the attachment parts at the other of the ends of the light source unit.

* * * * *